US011952189B2

(12) United States Patent
Blehm et al.

(10) Patent No.: US 11,952,189 B2
(45) Date of Patent: Apr. 9, 2024

(54) ARTICLE CARRIER AND BLANK THEREFOR

(71) Applicant: WestRock Packaging Systems, LLC, Atlanta, GA (US)

(72) Inventors: Elina Blehm, Herl (DE); Gregory P. Hayter, Atlanta, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 278 days.

(21) Appl. No.: 17/298,400

(22) PCT Filed: Nov. 25, 2019

(86) PCT No.: PCT/US2019/062932

§ 371 (c)(1),
(2) Date: May 28, 2021

(87) PCT Pub. No.: WO2020/112597

PCT Pub. Date: Jun. 4, 2020

(65) Prior Publication Data

US 2022/0119177 A1 Apr. 21, 2022

Related U.S. Application Data

(60) Provisional application No. 62/773,269, filed on Nov. 30, 2018.

(51) Int. Cl.
*B65D 71/58* (2006.01)

(52) U.S. Cl.
CPC ..... *B65D 71/0022* (2013.01); *B65D 2571/00141* (2013.01); *B65D 2571/00388* (2013.01); *B65D 2571/00487* (2013.01); *B65D 2571/00524* (2013.01); *B65D 2571/0066* (2013.01); *B65D 2571/00753* (2013.01); *B65D 2571/0087* (2013.01)

(58) Field of Classification Search
CPC ..... B65D 71/0022; B65D 75/00; B65D 2571/00141; B65D 2571/00277; B65D 2571/00388; B65D 2571/00487; B65D 2571/00524; B65D 2571/0066; B65D 2571/00728; B65D 2571/00753; B65D 2571/0087; B65D 71/58
USPC ..... 206/174, 175, 180
See application file for complete search history.

(56) References Cited

U.S. PATENT DOCUMENTS 2,575,654 A 11/1951 Casler
6,341,689 B1 * 1/2002 Jones ..... B65D 71/0022 206/427

(Continued)

FOREIGN PATENT DOCUMENTS

GB 909479 A * 10/1962 ..... B65D 71/0022

*Primary Examiner* — Bryon P Gehman
(74) *Attorney, Agent, or Firm* — Brian J. Goldberg; Rohini K. Garg

(57) ABSTRACT

Aspects of the disclosure relate to an article carrier for packaging a plurality of articles. The article carrier (90) comprises a plurality of primary panels (16, 18, 20, 22, 24, 26) which form a tubular structure having an interior chamber. The plurality of primary panels includes: a first panel (14, 28); and a second panel (18, 24) opposing the first panel (14, 28). The carrier (90) further comprises a partition structure (P1, P2) dividing the interior chamber into two or more article-receiving cells.

13 Claims, 7 Drawing Sheets

(56) References Cited

U.S. PATENT DOCUMENTS

| | | | |
|---|---|---|---|
| 2015/0321816 | A1 | 11/2015 | Holley, Jr. |
| 2016/0152389 | A1 | 6/2016 | Holley, Jr. |

* cited by examiner

ARTICLE CARRIER AND BLANK THEREFOR

TECHNICAL FIELD

The present invention relates to carriers and to blanks for forming the same. More specifically, but not exclusively, the invention relates to a carrier having a partition structure feature defining cells or compartments within an interior of a carrier of the basket-style.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present invention to provide to a carrier having a partition structure for separating articles within an interior chamber of the carrier. It is desirable to minimise or reduce the material required to produce the carrier for economic or environmental benefit or both.

It is desirable that the blank from which the carrier is formed can be readily assembled into a carrier in a simple and efficient manner.

The present invention seeks to provide an improvement in the field of cartons, typically formed from paperboard or the like.

SUMMARY

A first aspect of the invention provides an article carrier for packaging a plurality of articles. The article carrier comprises a plurality of primary panels for forming a tubular structure providing an interior chamber. The plurality of primary panels includes a first panel and a second panel opposing the first panel. The carrier may comprise a partition structure for dividing the interior into two or more article-receiving cells. The partition structure may be formed from the first panel and comprises a lateral partition panel hingedly connected at a proximal end thereof to the first panel by a first fold line. The partition structure comprises a joint panel hingedly connected to a distal end portion of the lateral partition panel by a second fold line and a glue panel hingedly connected to the joint panel by a third fold line. The joint panel may be angled with respect to the distal end portion. The length of the joint panel may be greater than the length of the end portion.

Optionally, a lateral partition panel has a length defined by a first distance extending between a first fold line and a distal end of the lateral partition panel and wherein the first distance is generally equal to a second distance between the first panel and a second panel.

Optionally, the second and third fold lines are substantially parallel to each other.

Optionally, the second fold line comprises a pair of intersecting tear stoppers and a weakened line disposed between the tear stoppers.

Optionally, a distal end of a lateral partition panel abuts against a second panel, so as to stabilise the position of the distal end, in cooperation with an angled joint panel.

Optionally, a lateral partition panel forms a brace between first and second panels.

Optionally, a carrier comprises at least two relief cuts, the relief cuts defining an area of a first panel therebetween, said area being a glue free area, unsecured to another panel of the carrier.

Optionally, relief cuts and a glue free area create a displaceable region so as to create adjustability of the length of a lateral partition panel.

Optionally, the tubular structure is collapsible.

Optionally, the partition structure is automatically erected when the tubular structure is erected from a collapsed condition.

Optionally, the tubular structure comprises an end closed at least in part by one or more bottom panels.

A second aspect of the invention provides an article carrier for packaging a plurality of articles. The article carrier comprises a plurality of primary panels defining an interior of the article carrier. The plurality of primary panels includes first and second opposed side panels for forming a tubular structure. The plurality of primary panels may include a medial partition wall interposed parallel between the first and second side panels to divide the interior into two or more article-receiving cells. The plurality of primary panels may include a pair of end closure flaps which at least partially close one of opposed ends of the tubular structure. The end closure flaps comprise at least one press-activated locking feature for interconnecting the end closure flaps. The medial partition wall comprises a backing edge extending alongside an inside surface of at least one of the end closure flaps. The backing edge of the medial partition wall has at least one recess defined therealong and arranged in registration with the at least one press-activated locking feature.

A press-activated locking feature may be received in a void between a first wall, such as a medial partition wall, and a second wall, such as an end closure flap. The first wall may define a first plane and the second wall may be define a second plane. The second plane may be orthogonal to the first plane. The void is defined in part by the at least one recess.

At least a portion of the press-activated locking feature may past through a cutaway in the first wall, medial partition wall, the cutaway defined in part by the at least one recess.

A third aspect of the invention provides a blank for forming an article carrier. The blank comprises a plurality of primary panels for forming walls of a tubular structure defining an interior chamber. The plurality of primary panels includes a first panel and a second panel opposing the first panel. The blank further may comprise a partition structure for dividing the interior into two or more article-receiving cells. The partition structure may be formed from the first panel. The partition structure may comprise a lateral partition panel hingedly connected at a proximal end thereof to the first panel by a first fold line. The partition structure may comprise a joint panel hingedly connected to a distal end portion of the lateral partition panel by a second fold line. The partition structure may comprise a glue panel hingedly connected to the joint panel by a third fold line. The joint panel may be configured to be angled with respect to the distal end portion in a setup carrier. The length of the joint panel may be greater than the length of the end portion.

A fourth aspect of the invention provides a blank for forming an article carrier. The blank comprises a plurality of primary panels for forming walls of a tubular structure defining an interior chamber. The plurality of primary panels includes first and second opposed side panels for forming a tubular structure. The plurality of primary panels may include a medial partition wall for being interposed parallel between the first and second side panels to divide the interior of the carrier into two or more article-receiving cells. The plurality of primary panels may include a pair of end closure flaps which at least partially close one of opposed ends of the tubular structure. The end closure flaps may comprise at least one press-activated locking feature for interconnecting the end closure flap. The medial partition wall comprises a backing edge for extending alongside an inside surface of at least one of the end closure flaps in a setup condition. The backing edge of the medial partition wall has at least one recess defined therealong and arranged to be in registration with the at least one press-activated locking feature.

Further features and advantages of the present invention will be apparent from the specific embodiments illustrated in the drawings and discussed below.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment may be applicable to all embodiments unless there is an incompatibility of features. One or more features or elements from one embodiment may be incorporated into, or combined with, any of the other embodiments disclosed herein. The features or elements extracted from said one embodiment may be included in addition to, or in replacement of one or more features or elements of the other embodiments. The term "other embodiments" as used herein may refer to d article carriers of different configurations such as 1×2, 1×3, 1×4, 1×5, 2×2, 2×4, 2×5, etc.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
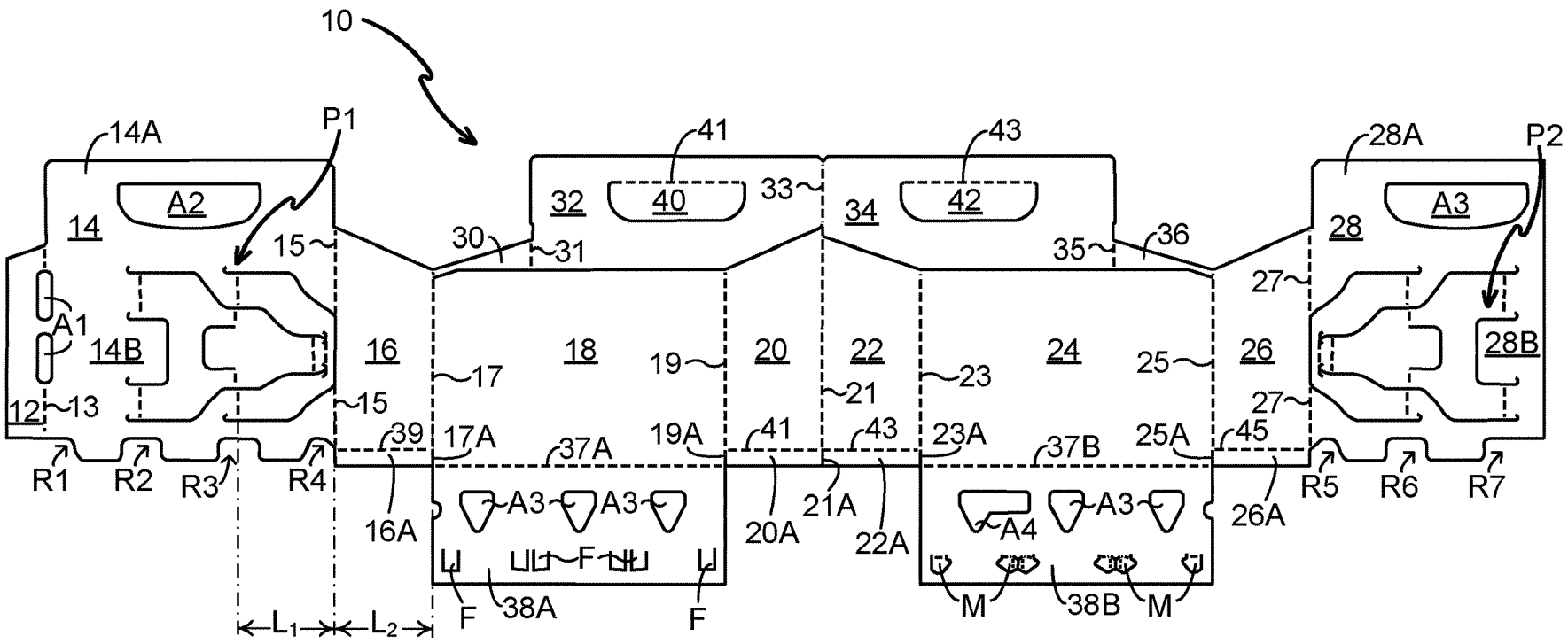
FIG. 1 is a plan view from above of a blank for forming a carrier according to a first embodiment.
Figure 3:
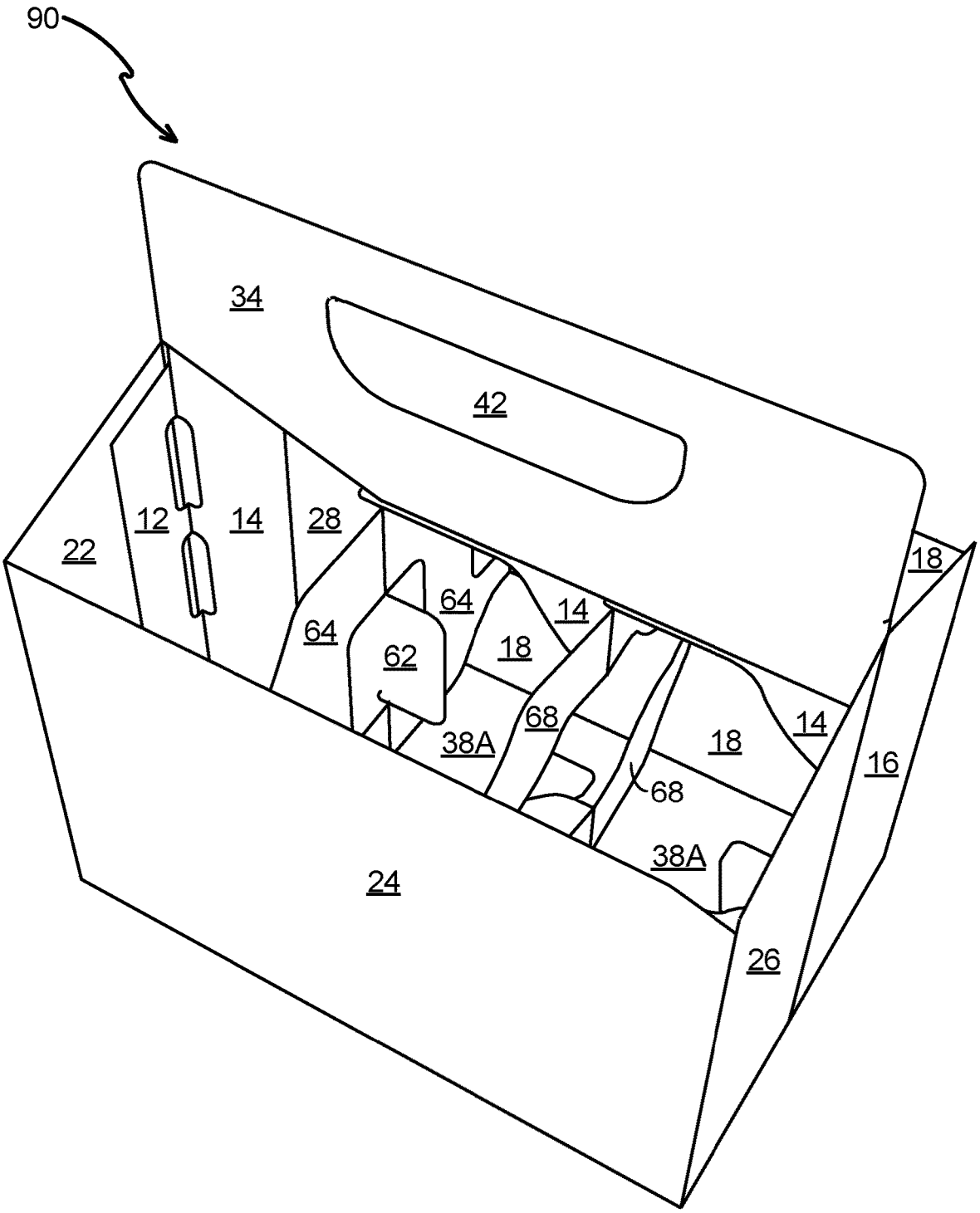
FIG. 3 is a perspective view from above of a carton formed from the blank of FIG. 1.
Figure 4:
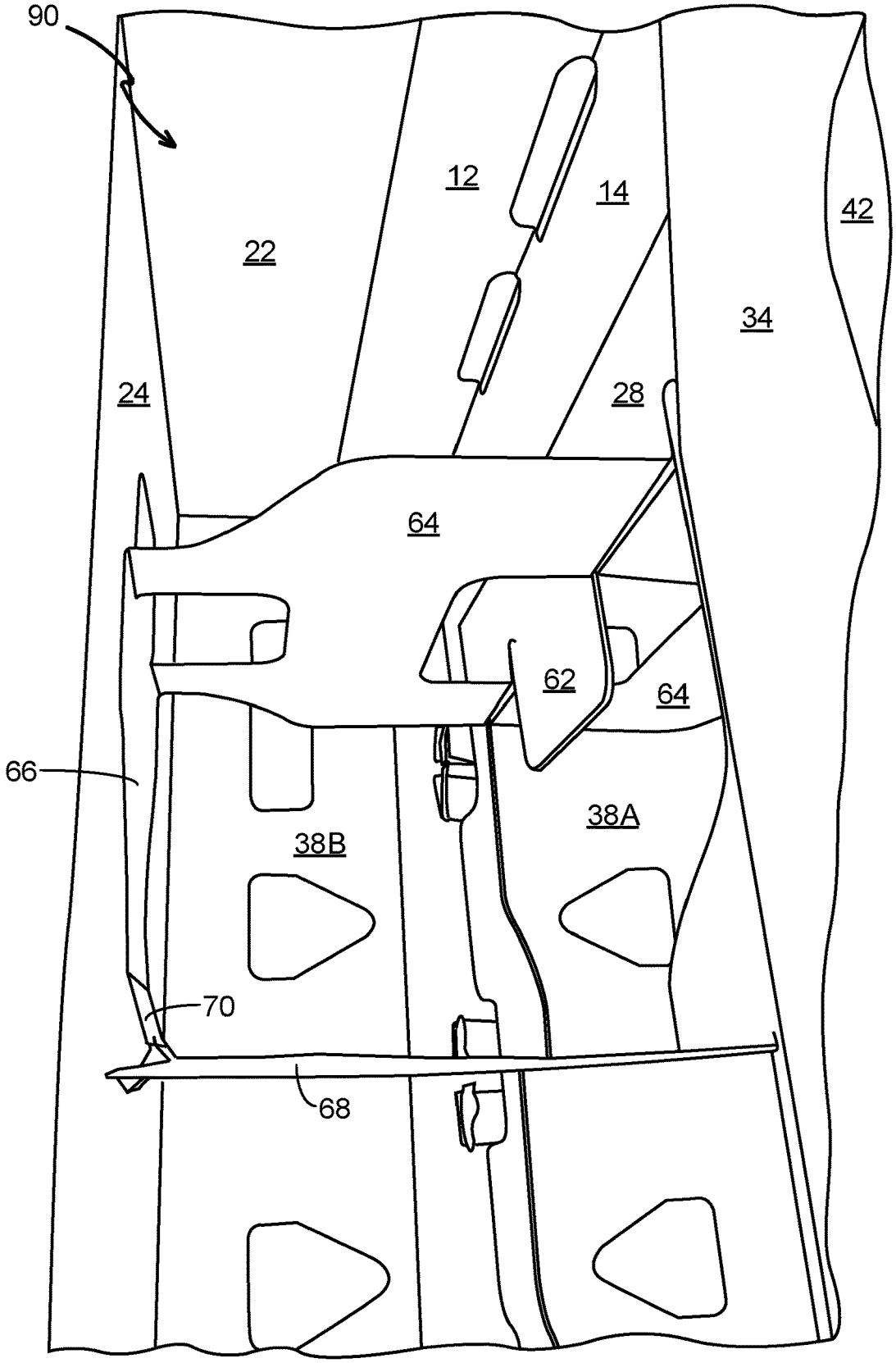
FIG. 4 is a perspective view of an interior portion of a carton formed from the blank of FIG. 1.
Figure 5:
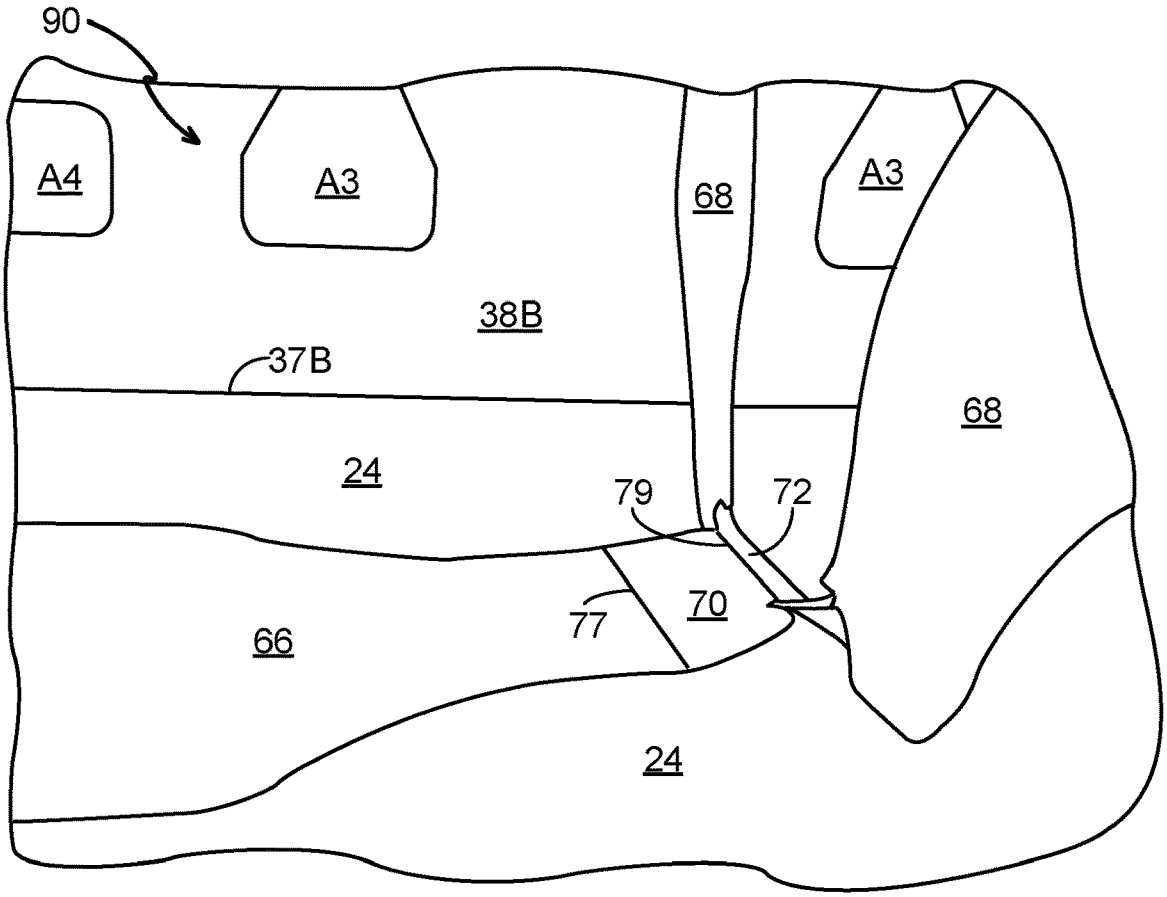
FIGS. 5, 6 and 7 are further perspective views of an interior portion of a carton formed from the blank of FIG. 1.

Referring to FIG. 1, there is shown a plan view of a blank 10 capable of forming a carton or carrier 90, as shown in FIG. 3, for containing and carrying a group of primary products such as, but not limited to, bottles, hereinafter referred to as articles. The blank 10 forms a secondary package of the basket-carrier style for packaging at least one primary product container or package.

In the embodiments detailed herein, the terms "carton" and "carrier" refer, for the non-limiting purpose of illustrating the various features of the invention, to a container 90 for engaging and carrying articles, such as primary product containers. It is contemplated that the teachings of the invention can be applied to various product containers, which may or may not be tapered and/or cylindrical. Other exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles. In the illustrated embodiments the arrangement is an m×n matrix or array, having two rows (m=2) and three columns (n=3); in the illustrated embodiment two rows of three articles are provided, and the articles are 300 ml bottles, the bottles may be formed from a suitable material such as, but not limited to, glass, Aluminium or PET (polyester-polyethylene terephthalate). Alternatively, the blank 10 can be configured to form a carrier for packaging other types, number and size of articles and/or for packaging articles in a different arrangement or configuration for example, but not limited to, fully enclosed cartons or wrap-around carriers, the articles may be cups, pouches, pots or cans.

Turning to FIG. 1, there is illustrated a blank 10 for forming a carton 90 (see FIG. 3) according to a first embodiment. The blank 10 comprises a plurality of panels 12, 14, 16, 18, 20, 22, 24, 26, 28 arranged in a linear series hinged one to the next by fold lines 13, 15, 17, 19, 21, 23, 25, 27 respectively.

The blank 10 comprises a plurality of outer panels 16, 18, 20, 22, 24, 26 for forming a tubular structure. The plurality of outer panels 16, 18, 20, 22, 24, 26 comprises a first end panel 16.

A first side panel 18 is hingedly connected to the first end panel 16 by a hinged connection in the form of a fold line 17. A second end panel 20 is hingedly connected to the first side panel 18 by a hinged connection in the form of a fold line 19. A third end panel 22 is hingedly connected to the second end panel 20 by a hinged connection in the form of a fold line 21. A second side panel 24 is hingedly connected to the third side panel 22 by a hinged connection in the form of a fold line 23 and a fourth end panel 26 is hingedly connected to the second side panel 24 by a hinged connection in the form of a fold line 25.

The blank 10 comprises a first base panel 38*a* hinged to the first side panel 18 by a hinged connection in the form of a fold line 37*a*. The blank 10 comprises a second base panel 38*b* hinged to the second side panel 24 by a hinged connection in the form of a fold line 37*b*. The first and second base panels 38*a*, 38*b* are also referred to herein as end closure flaps since they close an end of the tubular structure formed by the plurality of outer panels 16, 18, 20, 22, 24, 26.

The first and second base panels 38*a*, 38*b* are engageable with one another in an overlapping relationship to form a composite base wall 38*a*/38*b* of the carrier 90. The blank 10 may comprise a complementary locking mechanism (also referred to as a press-activated locking feature) for securing the first base panel 38*a* to the second base panel 38*b*. The second base panel 38*b* may comprise at least one first part M of the complementary locking mechanism. The first base panel 38*a* may comprise at least one second part F of the complementary locking mechanism. In the illustrated embodiment, the second base panel 38*b* comprises four male tabs M struck therefrom so as to be defined within the f second base panel 38*b*. Each of the male tabs M is hingedly connected to the second base panel 38*b* by a hinged connection in the form of a fold line.

The second part F of the complementary locking mechanism forms a receiver. The receiver comprises an opening or slot for receiving the male tab M.

The first base panel 38*a* comprises four optional female tabs each defining an opening or slot in the first base panel 38*a*; the female tabs forming at least part of the receiver.

The openings in the first base panel 38*a* are configured to receive respective ones of the male tabs M.

The female tabs F are arranged to be displaced out of the first base panel 38*a* to form said openings and to bear against the respective male tab M when received therein. In some embodiments the complementary locking mechanism M/F may be omitted, the first and second base panels 38*a*, 38*b* may be secured to each other by other means, such as but not limited to adhesive or staples.

Optionally, the first and second base panels 38*a*, 38*b* may comprise at least one first aperture A3. In the illustrated embodiment, the first base panel 38*a* comprises three first apertures A3 and the second base panel 38*b* comprises two first apertures A3.

Optionally, the second base panel 38*b* may comprise at least one second aperture A4. In the illustrated embodiment, the second base panel 38*b* comprises one second apertures A4.

The first and second apertures A3, A4 may be employed to facilitate construction of the carrier 90. A packaging machine component or tool may engage with the first and second apertures A3, A4 to facilitate alignment of the first and second base panels 38*a*, 38*b* with respect to each other or to align the first part M of the complementary locking mechanism with the second part F of the complementary locking mechanism. The complementary locking mechanism illustrated and described is entirely optional.

The blank 10 may comprise a medial structure including a first medial panel 14 and a second medial panel 28. Medial panels 14, 28 are also referred to herein as intermediate panels.

The first medial panel 14 is hingedly connected at a first end of the plurality of outer panels 16, 18, 20, 22, 24, 26, to the first end panel 16, by a hinged connection in the form of a fold line 15.

The second medial panel 28 is hingedly connected at a second, opposing, end of the plurality of outer panels 16, 18, 20, 22, 24, 26, to the fourth end panel 26, by a hinged connection in the form of a fold line 27.

The first and second medial panels 14, 28 form a divider extending longitudinally between the end walls of the carrier 90.

The first medial panel 14 provides a first handle panel portion 14A. The second medial panel 28 provides a second handle panel portion 28A. Together the first and second medial panels 14, 28 provide a two-ply handle structure, the second ply reinforcing the first ply.

The first handle panel portion 14A comprises a first handle opening.

The first handle opening may be defined at least in part by a first handle aperture A2 struck from an upper portion of the first medial panel 14.

The second handle panel portion 28A comprises a second handle opening.

The second handle opening may be defined at least in part by a second handle aperture A3 struck from, or defined within, an upper portion of the second medial panel 28.

The second handle opening is arranged to be disposed in registry or alignment with the first handle opening in a setup condition.

The blank 10 comprises a securing panel in the form of a medial partition glue flap 12 hingedly connected to an end of the first medial panel 14 (said end opposes an opposing end of the first medial panel 14 to which the first end panel 16 is hingedly connected, defined by fold line 15) by a hinged connection in the form of a fold line 13. The fold line 13 may be interrupted by at least one cutaway in the form of an aperture A1, in the illustrated embodiment two apertures A1 interrupt fold line 13 so as to reduce the folding resistance.

Optionally, the blank comprises a handle reinforcing structure comprising a first and second handle reinforcing panels 32, 34.

The first handle reinforcing panel 32 is disposed adjacent to the second end panel 20 and to the first side panel 18. First handle reinforcing panel 32 is separated from second end panel 20 by a first cutline. The first handle reinforcing panel 32 is separated from first side panel 18 by a second cutline.

The first handle reinforcing panel 32 is hingedly connected to second handle reinforcing panel 34 by a hinged connection in the form of a fold line 33.

The second handle reinforcing panel 34 is disposed adjacent to the third end panel 22 and to the second side panel 24. Second handle reinforcing panel 34 is separated from third end panel 22 by a third cutline. The second handle reinforcing panel 34 is separated from second side panel 24 by a fourth cutline. The second handle reinforcing panel 34 is connected to second end panel 20 at a first side edge of the second handle reinforcing panel 34 by a connecting portion in the form of a hinged connection collinearly arranged with fold line 33 and fold line 21. The connecting portion 43 is sufficient to maintain the connection between the second handle reinforcing panel 34 and the second end panel 22 during handling of the blank 10 prior to assembly and optionally during at least a portion of the assembly process.

The handle structure comprises a first bridging panel 30, the first bridging panel 30 is disposed adjacent to the first side panel 18 and is separated therefrom by the second cutline. A first side edge of the first bridging panel 30 is coupled to a side edge of the first handle reinforcing panel 32 by a hinged connection in the form of a fold line 31. A second side edge of the first bridging panel 30 is coupled to a side edge of the first end panel 16 by a connecting portion in the form of a hinged connection collinearly arranged with fold line 17. The connecting portion is sufficient to maintain the connection between the first bridging panel 30 and the first end panel 16 during handling of the blank 10 prior to assembly and optionally during at least a portion of the assembly process.

The handle structure comprises a second bridging panel 36, the second bridging panel 36 is disposed adjacent to the second side panel 24 and is separated therefrom by the fourth cutline. A first side edge of the second bridging panel 36 is coupled to a side edge of the second handle reinforcing panel 34 by a hinged connection in the form of a fold line 35. A second side edge of the second bridging panel 36 is coupled to a side edge of the fourth end panel 26 by a connecting portion in the form of a hinged connection collinearly arranged with fold line 25. The connecting portion is sufficient to maintain the connection between the second bridging panel 36 and the fourth end panel 26 during handling of the blank 10 prior to assembly and optionally during at least a portion of the assembly process.

The first handle reinforcing panel 32 comprises a third handle opening. The third handle opening may be defined by an optional first cushioning flap 40 struck from the first handle reinforcing panel 32 and hinged thereto by a hinged connection in the form of a fold line 41. The first cushioning flap 40 defines at least a part of the third handle opening.

The second handle reinforcing panel 34 comprises a fourth handle opening. The fourth handle opening may be defined by an optional second cushioning flap 42 struck from the second handle reinforcing panel 34 and hinged thereto by a hinged connection in the form of a fold line 43. The second cushioning flap 42 defines at least a part of the first handle opening.

The third and fourth handle openings are arranged to be disposed in registry or alignment with the first and second handle openings in a setup carrier 90.

Optionally, the blank 10 comprise a fold line 39, 41, 43, 45 extending across a respective one of the end panel 16, 20, 22, 26. Each fold line defines at least in part a foldable portion 16A, 20A, 22A, 26A disposed along a lower end of the respective one of the end panel 16, 20, 22, 26. The foldable portion 16A, 20A, 22A, 26A may be defined in part by one or more cut lines 17A, 19A, 21A, 23A, 25A each of which is collinearly arranged with a respective one of the fold lines 17, 19, 21, 23, 25 hinging the outer panels together. In alternative embodiments, the fold lines 39, 41, 43, 45 may be omitted.

The blank 10 may comprise a partition structure P1, P2 which defines or creates a plurality of cells disposed on one or both sides of the divider formed by first and second medial panels 14, 28.

Figure 1B:
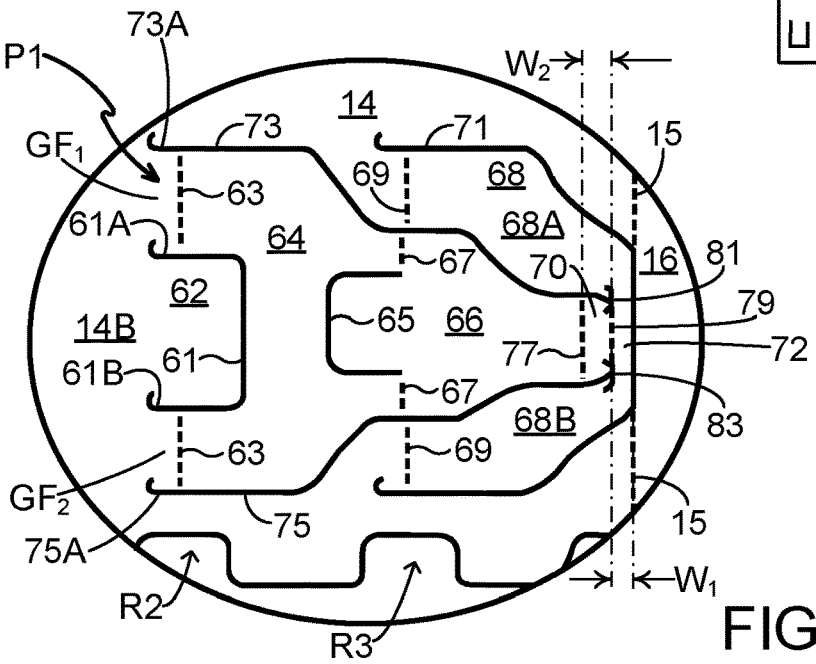
FIG. 1B is an enlarged view of a portion of the blank of FIG. 1.

The blank 10 comprises a first partition structure P1 best illustrated in FIG. 1B. The first partition structure P1 defines or creates a plurality of cells disposed between the first side panel 18 and the first medial panel 14. The first partition structure P1 is defined in a first partition panel portion 14B provided by a lower portion of the first medial panel 14.

The blank 10 comprises a second partition structure P2. The second partition structure P2 defines or creates a plurality of cells disposed between the second side panel 24 and the second medial panel 28. The second partition structure P2 is defined in a second partition panel portion 28B provided by a lower portion of the second medial panel 28.

The first side panel 18 and the second medial panel 14 along with the first and second end panels 16, 20 define a tubular structure or first compartment on a first side of the medial structure or divider.

The second side panel 24, the second medial panel 28 along with the third and fourth end panels 22, 26 and a portion of the first medial panel 14 define a tubular structure or second compartment on a second side of the medial structure or divider.

The first compartment provides an interior for receiving at least a lower portion of one or more articles. The second compartment provides an interior for receiving at least a lower portion of one or more articles.

The first and second partition structures P1, P2 are substantially similar in construction, albeit the second partition structure P2 is a mirror image (in blank form) of the first partition structure P1. In this way the first and second partition structures P1, P2 are disposed substantially in registry with each other when the blank 10 is folded into a flat collapsed form (see FIG. 2B). The first and second partition structures P1, P2 will be described in further detail by reference to the first partition structure P1 as illustrated in FIG. 1B.

The first partition structure P1 comprises a first partition panel 64 struck from, or defined in, the first medial panel 14 and hingedly connected, at a first or proximal end, thereto by a hinged connection in the form of a fold line 63.

The first partition structure P1 comprises a second partition panel 68 struck from, or defined in, the first medial panel 14 and hingedly connected, at first or a proximal end, thereto by a hinged connection in the form of a fold line 69.

The first and second partition panels 64, 68 are dimensioned to extend, laterally, between the first medial panel 14 and the first side panel 18 in a set up condition. The first partition structure P1 comprises a glue panel 66 to which the first and second partition panels 64, 68 are each coupled by distal end joints.

The first partition panel 64 is hingedly connected, at a second or distal end, to a first end of the glue panel 66 by a hinged connection in the form of fold line 67. Fold line 67 defines an outer end of the first partition panel 64, fold line 63 defines an inner end of the first partition panel 64 a linear dimension is defined therebetween.

The second partition panel 68 is hingedly connected to a second end of the glue panel 66 by a hinged connection in the form of fold line 79. The second partition panel 68 comprises an outer end, defined by a portion of cutline 71 which may be collinear, coincident or coextensive with the fold line 15 between the first medial panel 14 and the first end panel 16. Fold line 79 is offset, inset from, the outer end of the second partition panel 68. Fold line 69 defines an inner end of the second partition panel 68. The outer end of the second partition panel 68 and the fold line 69 define a linear dimension $L_1$ therebetween.

The second partition panel 68 is separated from the glue panel 66 along or by a cut line or severance line 71. The second partition panel 68 may be severably coupled to the glue panel 66 by one or more connecting portions or nicks which interrupt the cut line or severance line 71.

The second partition panel 68 is separated from the glue panel 66 by a pair of cut lines or severance lines 73, 75. The glue panel 66 can be considered to be struck from or defined in, at least in part, the second partition panel 68.

The glue panel 66 is defined in part by a further cutline 65 which is substantially 'C' or 'U' shaped. The further cutline 65 defines a part of the glue panel 66 which can be considered to be struck from or defined in, at least in part, the first partition panel 64. The further cutline 65 defines a tab or extension of the glue panel 66 which interrupts the fold line 67 hinging the glue plane 66 to the first partition panel 64.

The first partition structure P1 comprises a second substantially 'U' shaped cutline 61 defining a tab or projection 62 of the first medial panel 14 which is struck from or defined in the first partition panel 64. The cutline 61 interrupts the fold line 63 hinging the first partition panel 64 to the first medial panel 14.

Each end of the cutline 61 may extend beyond fold line 63 into the first medial panel 14 and may terminate with a "J" shaped cut.

Each end of the cutline 71 may extend beyond fold line 69 into the first medial panel 14 and may terminate with a "J" shaped cut.

A first end of cutline 73 may extend beyond fold line 63 into the first medial panel 14 and may terminate with a "J" shaped cut.

A first end of cutline 75 may extend beyond fold line 63 into the first medial panel 14 and may terminate with a "J" shaped cut.

A second end of cutline 73 terminates in the second partition panel 68, optionally the second end of cutline 73 terminates with a "C" shaped cut 81.

A second end of cutline 75 terminates in the second partition panel 68, optionally the second end of cutline 75 terminates with a "C" shaped cut 83.

The cut lines 81, 83 form tear stoppers, structures which prevent or inhibit tears from propagating or initiating from the cut lines 73, 75.

A fold line 79 extends between the second end of cutline 73 and the second end of cutline 75. The fold line 79 is arranged to be substantially parallel with fold line 15. The fold line 79 is spaced apart from the outer end of the second partition panel 68.

The glue panel 66 is hingedly connected to the second partition panel 68 by the fold line 79. The glue panel 66 comprises further fold line 77. The fold line 77 is arranged to be substantially parallel with fold line 79, so as to define a connecting panel portion 70 (also referred to herein as joint panel 70) coupling the glue panel 66 to the second partition panel 68.

The first partition panel 64 and glue panel 66 are defined in part by cut line or severance line 73.

The first partition panel 64 and glue panel 66 are defined in part by cut line or severance line 75.

The first partition panel 64 is separated from the first medial panel 14 by portions of the cut lines 73, 75 and by cutline 61.

The glue panel 66 is separated from the second partition panel 68 by portions of the cut lines 73, 75.

The second partition panel 68 is separated from the first medial panel 14 by the cut line 71.

The fold line 79 defines, at least in part an end portion or region 72 of the second partition panel 68. The end portion 72 may be defined between the fold line 79 and the portion of the cut line 71 which is coextensive with the fold line 15.

Figure 8A:
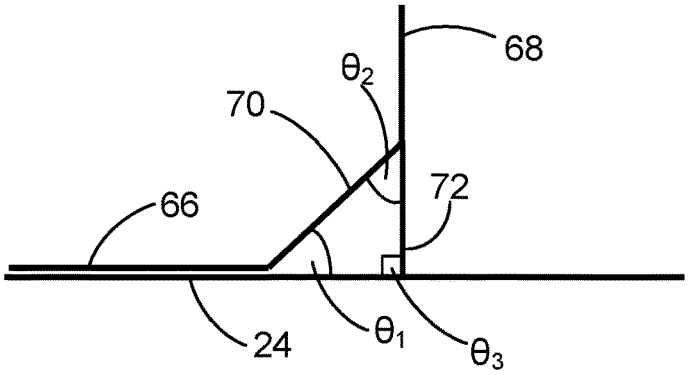
FIG. 8A is a schematic illustration of a portion of the carton of FIG. 1 according to one embodiment.

In some embodiments, see FIG. 8A, the end portion 72 is disposed substantially perpendicular to the respective one of the first and second side panels (second side panel 24 is shown in FIG. 8A) to which the partition structure P1, P2 is secured.

The joint panel 70 is obliquely oriented, or non-parallel, with respect to the respective one of the first and second side panels (second side panel 24 is shown in FIG. 8A) to which the partition structure P1, P2 is secured.

In this way the joint panel 70 is divergently arranged with respect to the respective one of the first and second side panel.

Figure 8B:
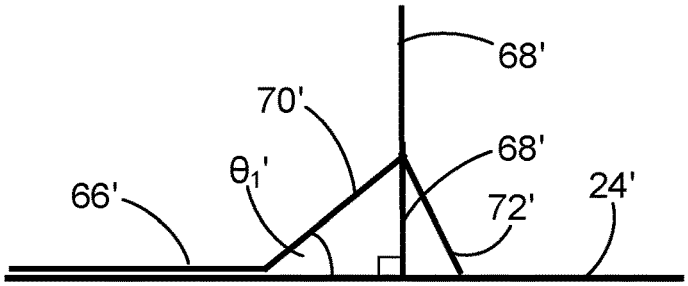
FIG. 8B is a schematic illustration of a portion of the carton of FIG. 1 according to another embodiment.
Figure 6:
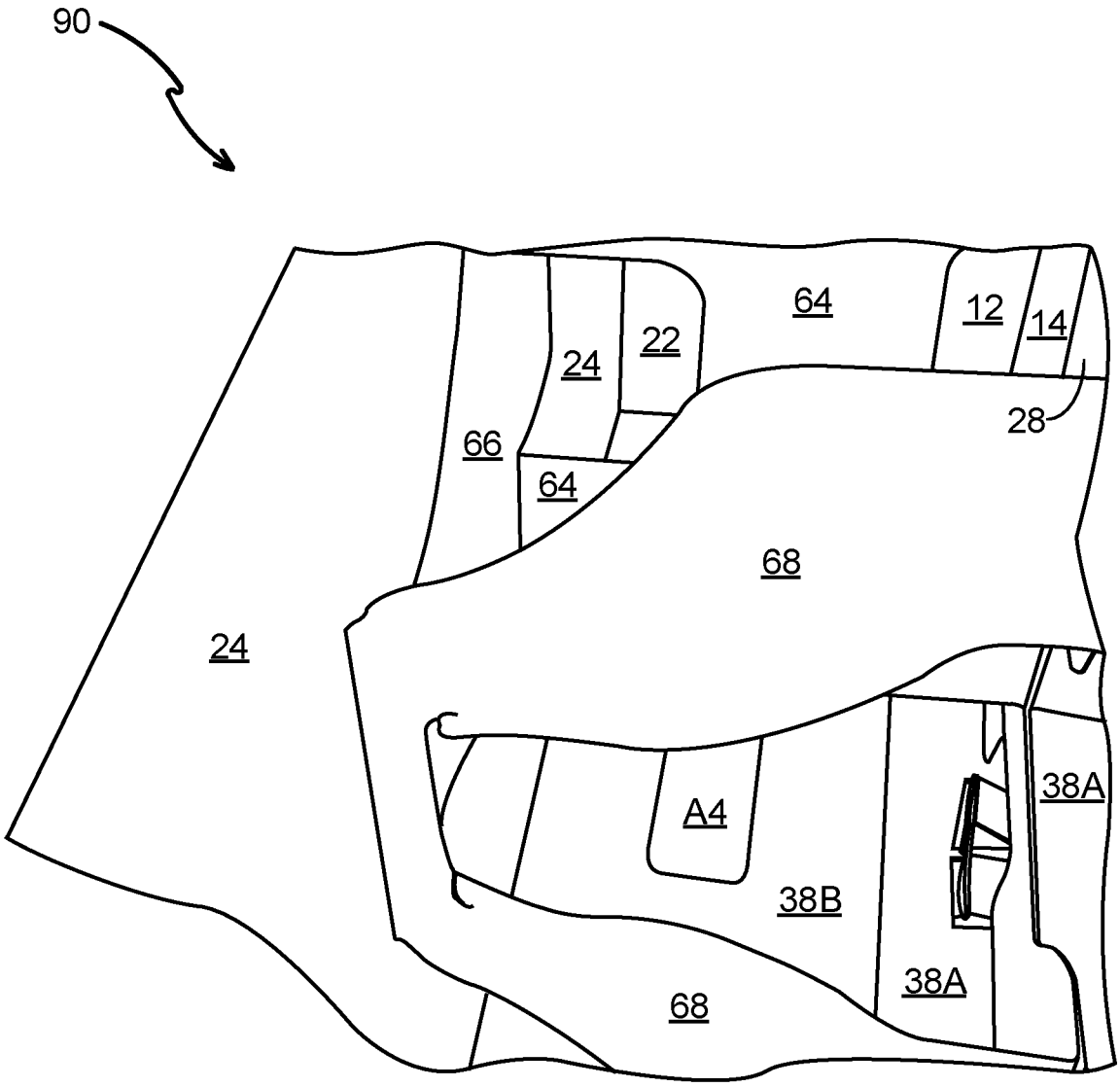

In other embodiments, see FIG. 8B, the end portion 72' is obliquely angled with respect to the respective one of the first and second side panels (second side panel 24' is shown in FIG. 8B) to which the partition structure P1, P2 is secured. The end portion 72' is obliquely angled with respect to the remainder of the second partition panel 68'. The cut lines 81, 83 (not shown in FIG. 8B) provide relief features enabling ends of the end portion 72' to twist or otherwise deform. The relief features enable the end portion 72' to transition, without tearing, between the obliquely angled section 72' to an upper or lower limb 68A, 68B (see FIG. 1B) which is substantially perpendicularly oriented with respect to the respective one of the first and second side panels to which the partition structure P1, P2 is secured.

The joint panel 70' is obliquely oriented with respect to the respective one of the first and second side panels (second side panel 24' is shown in FIG. 8B) to which the partition structure P1, P2 is secured.

In some embodiments, see FIG. 8A, the joint panel 70 defines part of a right-angled triangle, the joint panel 70 defining the hypotenuse of the right-angled triangle.

The end portion 72 has a length or width dimension $W_1$, the width dimension $W_1$ may be 6 mm in some embodiments. The joint panel 70 has a first linear dimension, length or width, $W_2$ defined between fold line 77 and fold line 79, the second linear dimension $W_2$ may be about 8.5 mm. The joint panel 70 and the side panel 24 define an angle $\theta_1$ therebetween, in some embodiments the angle $\theta_1$ may be 45°, as illustrated in FIG. 8A.

The width dimension $W_1$ of the end portion 72 may define the distance of the fold line 79 from the side panel 18, 24.

The first linear dimension $W_1$ of the end portion 72 may be less than the second linear dimension $W_2$ of the joint panel 70, ($W_1<W_2$).

The joint panel 70 and the end portion 72 define a second angle $\theta_2$ therebetween. The side panel 24 and the end portion 72 define a third angle $\theta_3$ therebetween.

The second angle $\theta_2$ may be greater than, or not equal to, zero degrees ($\theta_2>0°$) ($\theta_2\neq0°$). The third angle $\theta_3$ may be greater than the first angle $\theta_1$ ($\theta_3>\theta_1$).

In other embodiments, see FIG. 8B, the joint panel 70' and side panel 24' define an angle $\theta_1'$ therebetween, the angle $\theta_1'$ may be less than 45°.

The joint panel 70 defines a glue-free region along an end edge of the glue panel 66.

The second partition panel 68 is hinged to the first medial panel 14 by fold line 69, fold line 69 and the portion of the cut line 71 which is coextensive with the fold line 15 define a third linear dimension, length or width, $L_1$ of second partition panel 68.

The first end panel 16 comprises a fourth linear dimension, length or width, $L_2$ defined between fold line 15 and fold line 17.

The third linear dimension $L_1$ is substantially equal to the fourth linear dimension $L_2$.

The fold line 69 providing the hinged connection between the second partition panel 68 and the first medial panel 14 is spaced apart from, or located at, a distance the fold line 15 equal to the third linear dimension $L_1$.

The fourth linear dimension $L_2$ substantially defines the distance separating the first medial panel 14 and the first sidewall 18 of the carrier 90.

In other embodiments the tear stoppers, cut lines 81, 83, may be replaced by an alternative element. The element may take the form of a cutaway, extending in at least one of the second partition panel 68 and the glue panel 66. The element may be a cutline. The element may be a nonlinear cutline or may be comprised of two or more divergently arranged linear cut lines. The element may be arcuate or curvilinear. In other embodiments the element may be an aperture, slot, slit, oval slot or frangible line. In the embodiment illustrated in FIG. 1B the element is a curved element and extends into both the second partition panel 68 and the glue panel 66. The curved element comprises at least one terminal end which is spaced apart from an adjacent end edge of the end portion 72 provided by the end edge of the second partition panel 68.

By providing a pair of elements spaced apart from each other, the joint panel 70 may rotate out of the plane of the second partition panel 68. In this way, a hinge is created between the joint panel 70 and the second partition panel 68.

The hinge may be resiliently biased, due to the inherent resilience of the substrate.

The hinge may provide resistance to tearing or severance of the joint panel 70 from the second partition panel 68. For example, when load forces cause movement of the side walls 18, 24 in an outward direction or to allow movement of the joint panel 70 towards a coplanar arrangement with the remainder of the glue panel 66.

The second partition panel 68 may comprise an upper limb 68A and a lower limb 68B. The upper and lower limbs 68A, 68B extend from the first medial panel 14 to the first side wall in a set up carrier 90. The upper and lower limbs 68A, 68B are coupled or interconnected by the end portion 72. In this way the second partition panel 68 may be substantially 'C' shaped or 'U' shaped.

The cut lines 81, 83 may provide stress relief elements which prevent or inhibit propagation or initiation of tears in the substrate when the end portion 72 is twisted or rotated with respect to the upper and lower limbs 68A, 68B.

The blank 10 is foldable to form a package 90 as illustrated in FIG. 2.

Turning to the construction of the carton 90 as illustrated in FIG. 2, the carton 90 can be formed by a series of sequential folding operations in a straight-line machine so that the carton 90 is not required to be rotated or inverted to complete its construction. The folding process is not limited to that described below and may be altered according to particular manufacturing requirements.

Glue or other adhesive treatment is applied to the third end panel 22 proximate the fold line 21. Alternatively, glue or other adhesive treatment may be applied to the medial partition glue flap 12.

Glue or other adhesive treatment is applied to the glue panel 66 of the first partition structure P1, the joint panel 70 is glue free. Alternatively, glue or other adhesive treatment may be applied to a corresponding region of the first side panel 18.

Glue or other adhesive treatment is applied to the first bridging panel 30. Alternatively, glue or other adhesive treatment may be applied to a corresponding region of the first end panel 16.

Glue or other adhesive treatment is applied to the first handle reinforcing panel 32. Alternatively, glue or other adhesive treatment may be applied to a corresponding region of the first handle panel portion 14A.

Figure 2A:
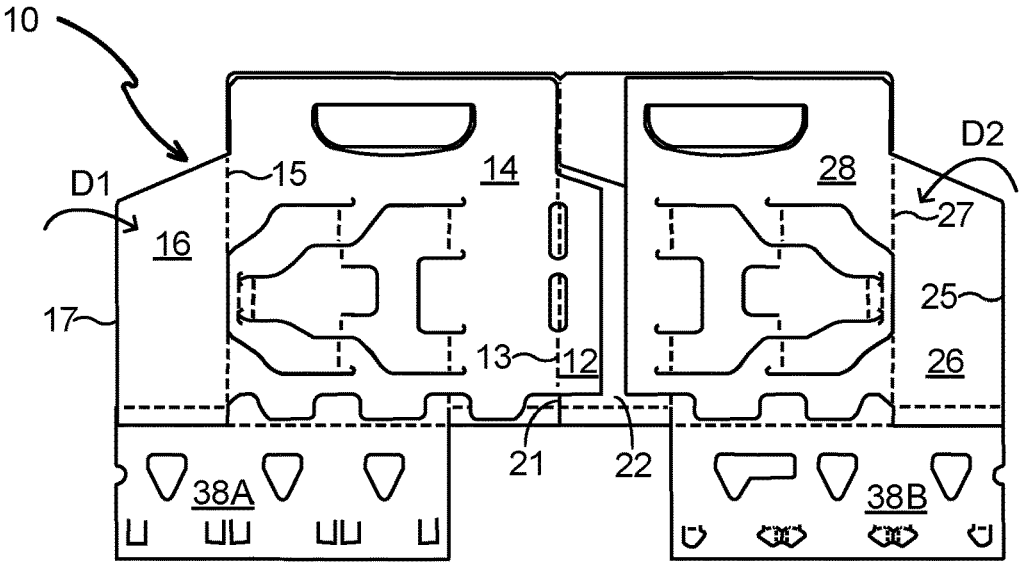
FIGS. 2A and 2B illustrate stages of construction of the blank of FIG. 1 into a flat collapsed carrier.

The first medial panel 14 and the first end panel 16 are folded, with respect to the first side panel 18 about fold line 17, as indicated by direction arrow D1 shown in FIG. 2A. The first medial panel 14 is brought into face contacting relationship with a portion of the first side panel 18 and the second end panel 20, the first end panel 16 is brought into face contacting relationship with a portion of the first side panel 18. The medial partition glue flap 12 is secured to the third end panel 22 in face contacting relationship therewith.

The glue panel 66 of the first partition structure P1 is secured to the first side panel 18.

The first bridging panel 30 is secured to the first end panel 16. The first handle reinforcing panel 32 is secured to the first handle panel portion 14A.

Glue or other adhesive treatment is applied to the glue panel 66 of the second partition structure P2, the joint panel 70 is glue free. Alternatively, glue or other adhesive treatment may be applied to a corresponding region of the second side panel 24.

Glue or other adhesive treatment is applied to the second bridging panel 36. Alternatively, glue or other adhesive treatment may be applied to a corresponding region of the fourth end panel 26.

Glue or other adhesive treatment is applied to the second handle reinforcing panel 34. Alternatively, glue or other adhesive treatment may be applied to a corresponding region of the second handle panel portion 28A.

The second medial panel 28 and the fourth end panel 26 are folded, with respect to the second side panel 24 about fold line 25, as indicated by direction arrow D2 shown in FIG. 2A. The second medial panel 28 is brought into face contacting relationship with a portion of the second side panel 24 and the third end panel 22, the fourth end panel 26 is brought into face contacting relationship with a portion of the second side panel 24.

The glue panel 66 of the second partition structure P2 is secured to the second side panel 24.

The second bridging panel 36 is secured to the fourth end panel 26. The second handle reinforcing panel 34 is secured to the second handle panel portion 28A.

Glue or other adhesive treatment is applied to the first medial panel 14, the first and second partition panel 64, 68 and the glue panel 66 are glue free. Alternatively, glue or other adhesive treatment may be applied to corresponding regions of the second medial panel 28.

Figure 2B:
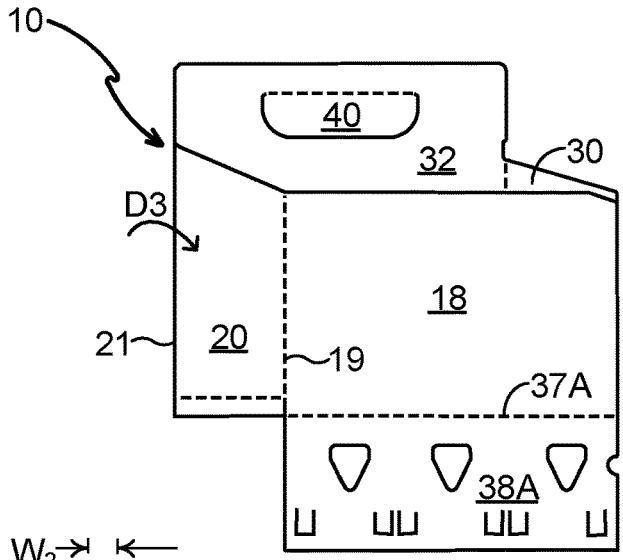

The second end panel 20, together with the first side panel 18, the first medial panel 14 and the first end panel 16, are folded about the fold line 21 to bring the first medial panel 14 into face to face relationship with the second medial panel 28 as indicated by direction arrow D3 in FIG. 2B.

The first medial panel 14 is secured to the second medial panel 28.

In this way a flat collapsed tubular structure is formed.

A flat collapsed carrier is thereby formed, as shown in FIG. 2B, the flat collapsed carrier can be readily shipped or distributed in the flat condition to a plant for erecting and loading with primary product containers.

The flat collapsed carrier can be opened into a basket-style article carrier by separating the first and second side panels 18, 24 to form a tubular structure defined by the outer panels 16, 18, 20, 22, 24, 26. The outer panels 16, 18, 20, 22, 24, 26 define an interior chamber. The partition structures P1, P2 are automatically erected when the flat collapsed carrier is opened out or erected into the tubular form.

Once the carrier 90 is erected, the first and second medial panels 14, 28 form a partition, that is disposed medially within the interior of the carrier 90 formed by the outer panels 16, 18, 20, 22, 24, 26. The partition divides the interior of the carrier 90 into two separate compartments on opposing sides of the first and second medial panels 14, 28.

The first partition structure P1 is automatically erected to form a first plurality of cells in a first compartment disposed on a first side of the first and second medial panels 14, 28.

The second partition structure P2 is automatically erected to form a second plurality of cells in a second compartment disposed on a second side of the first and second medial panels 14, 28.

The carrier 90 may be loaded with a group of articles; in the embodiment illustrated in FIG. 2 six articles (not shown) are arranged in a 3×2 array.

The group of articles may be loaded through a lower end of the tubular structure formed by the outer panels 16, 18, 20, 22, 24, 26 prior to folding the first and second base panel 38*a*, 38*b*. Alternatively, the group of articles may be loaded through an upper end of the tubular structure subsequent to assembly of the composite base panel 38*a*, 38*b*.

The first base panel 38A is folded with respect to the first side panel 18 about fold line 37A. The second base panel 38B is folded with respect to the second side panel 24 about fold line 37B. The second base panel 38B is brought into face contacting relationship with the first base panel 38A. The second base panel 38B is disposed in at least partial overlapping relationship with the first base panel 38A.

Each of the first parts M of the complementary locking mechanism is aligned with a respective one of the second parts F of the complementary locking mechanism. The first parts M of the complementary locking mechanism are folded inwardly of the interior of the carrier such that they are received by the second parts F of the complementary locking mechanism, when the second parts F of the complementary locking mechanism comprises female tabs these are also folded inwardly and may bear against the first parts M of the complementary locking mechanism.

The first and second medial partition panels 14, 28 each comprise at least one recess or cutaway for enabling the complementary locking mechanism to be assembled. The first medial partition panel 14 comprise four recesses R1, R2, R3, R4 defined in a lower free edge thereof and includes: first recess R1, second recess R2, third recess R3 and fourth recess R4. The second medial partition panel 28 comprise three recesses R5, R6, R7 defined in a lower free edge thereof and includes fifth recess R5, sixth recess R6 and seventh recess R7.

Each of the recesses R1, R2, R3, R4 provided by the first medial panel 14 is arranged to be disposed in registry, or at least partially aligned, with one of the recesses R5, R6, R7 provided by the second medial panel 28.

Fourth recess R4 is arranged to be disposed in registry with fifth recess R5. Sixth recess R6 is arranged to be disposed in registry with third recess R3 Seventh recess R7 is arranged to be at least partially aligned with second recess R2.

The second medial panel 28 may be shorter in length in the longitudinal direction of the carrier 90 than the first medial panel 14. An end portion of the first medial panel 14 providing the first recess R1 may be single ply, the second medial panel 28 does not obstruct, obscure or otherwise interfere with the first recess R1.

Figure 7:
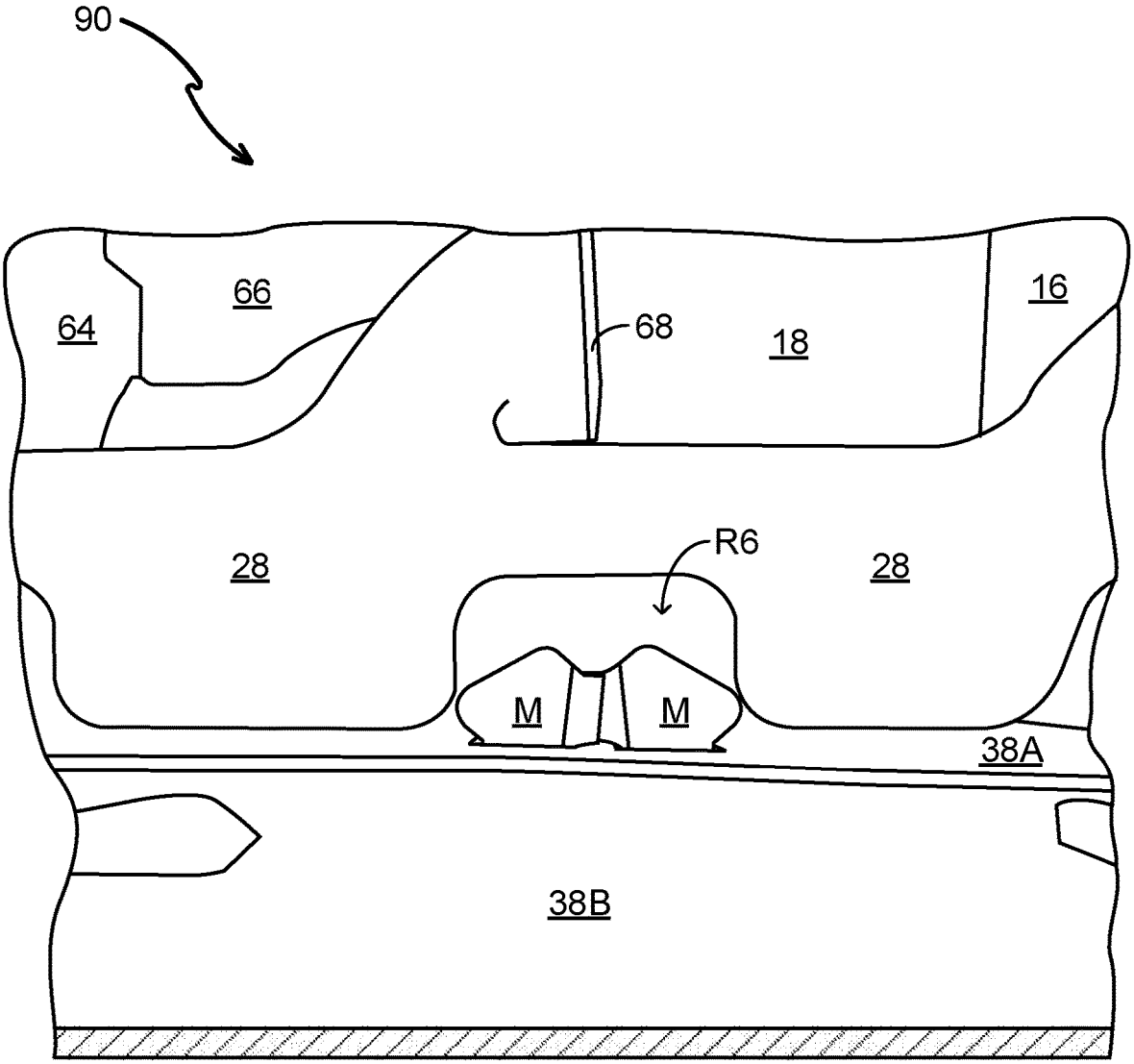

In this way the divider 14/28 formed from the first and second medial partition panels 14, 28 comprises at least one cutaway extending therethrough. The divider 14/28 comprises a plurality of cutaways, in the illustrated embodiment four cutaways are provided. FIG. 7 illustrate a first cutaway R4/R5, second cutaway R3/R6 and third cutaway R2/R7. The first recess R1 forms a fourth cutaway in the divider (not shown in FIG. 7).

The cutaways define voids between the base wall 38A/38B and the divider 14/28, the 14/28 is a wall orthogonally oriented with respect to the base wall 38A/38B.

The cutaways provide clearance for the complementary locking mechanism M/F to be set up. Each of the cutaways is arranged to be vertically aligned with one of the four male tabs M and with the corresponding female tab or receiver F when the first and second base panel 38A, 38B are folded about fold lines 37A, 37B to close the lower end of the tubular structure formed by the outer panels 16, 18, 20, 22, 24, 26. The cutaways enable the divider 14/28 to extend substantially from the base wall 38A/38B of the carrier 90 through the tubular structure formed by the outer panels 16, 18, 20, 22, 24, 26. The lowermost edge of the divider 14/28 may be in contact, or at least in close proximity to the base wall 38A/38B.

The divider 14/28 may extend towards the base wall 38A/38B so as to be below the upper extremity of the male tabs M when folded into an engaged or securing condition, best illustrated in FIG. 7.

The lowermost edge of the divider 14/28 may provide an end stop limiting travel of the first and or second base panel 38A, 38B when being folded into a closing condition.

The present disclosure provides an article carrier 90 comprising a plurality of primary panels 16, 18, 20, 22, 24, 26 forming a tubular structure defining an interior of the article carrier 90. The plurality of primary panels includes: a first panel 14, 28; and a second panel 18, 24 opposing the first panel 14, 28. The carrier 90 further comprises a partition structure P1, P2 dividing the interior into two or more article-receiving cells. The partition structure P1, P2 is formed from, or defined in, the first panel 14, 28 and comprises: a lateral partition panel 68 hingedly connected at a proximal end thereof to the first panel 14, 28 by a first fold line 69, a joint panel 70 hingedly connected to a distal end portion 72 of the lateral partition panel 68 by a second fold line 79; and a glue panel 66 hingedly connected to the joint panel 70 by a third fold line 77. The joint panel 70 is angled with respect to the distal end portion 72 and wherein the length $W_2$ of the joint panel 70 is greater than the length $W_1$ of the end portion 72.

The lateral partition panel 68 has a length defined by a first distance $L_1$ extending between the first fold line 69 and a distal end of the lateral partition panel 68 and wherein the first distance $L_1$ is generally equal to a second distance $L_2$ between the first panel 14, 28 and the second panel 18, 24.

The second and third fold lines 79, 77 are substantially parallel to each other.

The second fold line 79 comprises a pair of intersecting tear stoppers 81, 83 and a weakened line 79 (a cut or half cut) disposed between the tear stoppers 81, 83.

Advantageously, the distal end of the lateral partition panel 68 (including the outer edge of the end portion 72 is operable to be in abutment against the second panel 18, 24. This stabilises the position of the distal end of the lateral partition panel 68 in cooperation with the angled joint panel 70, which in turn enables the lateral partition panel 68 to effectively brace between the first panel 14, 28 and the second panel 18, 24.

The severance or cut lines 73, 61 and 75 comprise relief cuts in the form of cut lines extensions 73A, 61A, 61B 75A.

The cut lines extensions 73A, 61A define at least in part a first area $GF_1$ of the first panel 14, 28.

The cut lines extensions 75A, 61B define at least in part a second area $GF_2$ of the first panel 14, The areas $GF_1$, $GF_2$ of the first panel 14, 28 between the relief cuts are not glued to other areas of the carton (e.g. another medial or handle panel). The combination of the relief cuts and the non-glued areas $GF_1$, $GF_2$ may give effective tolerance/flexibility to the length $L_1$ of the lateral partition panel 68.

The present disclosure may also provide an article carrier 90 comprising a plurality of primary panels 16, 18, 20, 22, 24, 26 defining an interior of the article carrier 90. The plurality of primary panels include: first and second opposed side panels 18, 24 for forming a tubular structure, a medial partition wall 14, 28 interposed parallel between the first and second side panels to divide the interior into two or more article-receiving cells, and a pair of end closure flaps 38A, 38B which at least partially close one of opposed ends of the tubular structure. The end closure flaps 38A, 38B comprise at least one press-activated locking feature M for interconnecting the end closure flaps 38A, 38B. The medial partition wall 14, 28 comprises a backing edge extending alongside an inside surface of at least one of the end closure flaps 38A, 38B. The backing edge of the medial partition wall 14, 28 has at least one recess R1, R2, R3, R4, R5, R6, R7 defined therealong and arranged in registration with the at least one press-activated locking feature M, best illustrated in FIG. 7.

An advantage of the present disclosure is that the first partition structure comprises a reduced footprint, that is to say, it occupies less area of the blank. The first partition structure may also comprise a reduced linear dimension, in the longitudinal direction. In this way the first partition structure may be struck from within the first medial panel, the second partition structure may be struck from within the second medial panel.

The first/second partition structure may extend up to an edge of the first/second medial panel without extending beyond the edge of the first/second medial panel. In some embodiments this has the benefit that a panel adjacent to the first/second medial panel and hinged thereto is not interrupted or broken by the first/second partition structure, this may have structural benefits or aesthetic benefits or both.

Additionally, or alternatively, this may be beneficial when constructing the blank into a carrier, in particular into the flat collapsed carrier, such as that illustrated in FIG. 7. Construction of the blank into the carrier may be more readily automated. The reduction in size of the first/second partition structure may reduce the likelihood of the blank colliding with, catching upon, or otherwise unintentionally engaging with a part of a packaging machine, thus avoiding or mitigating against the blank becoming entangled, trapped, misfed or misaligned during the assembly process.

It can be appreciated that various changes may be made within the scope of the present invention. For example, the size and shape of the panels and apertures may be adjusted to accommodate articles of differing size or shape. The present invention is not limited to cartons of the basket carrier style, the invention may be employed with other carton styles such as, but not limited to, open top crates, lidded or closed top crates and fully enclosed cartons.

In one embodiment the medial panel may omitted, the partition structure may be formed from a first one of a pair of opposing wall panels, the opposing wall panels defining in part an interior of the carrier. The partition structure may divide the interior into two or more article receiving cells. The partition structure may comprise a lateral partition panel hingedly connected at a proximal end to said first one of the opposing wall panels by proximal end fold line and at its distal end to a glue panel by a distal end joint. The distal end connection between the lateral partition panel and the glue panel comprises a twistable end portion extending between and joined with the lateral partition panel and the glue panel. The lateral partition panel may have a length defined by a first distance defined between the proximal end fold line of the lateral partition panel and a distal end edge of the first lateral partition panel. The first distance may generally equal to a second distance defined between the first panel the second panel.

It will be recognised that as used herein, directional references such as "top", "bottom", "base", "front", "back", "end", "side", "inner", "outer", "upper" and "lower" do not necessarily limit the respective panels to such orientation but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line or a severance line or both. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier comprising a plurality of primary panels for forming a tubular structure and defining an interior of the article carrier, the plurality of primary panels including:

a first panel; and a second panel opposing the first panel;

wherein the carrier further comprises a partition structure for dividing the interior into two or more article-receiving cells, the partition structure being formed from the first panel and comprising:

a lateral partition panel hingedly connected at a proximal end thereof to the first panel by a first fold line;

a joint panel hingedly connected to a distal end portion of the lateral partition panel by a second fold line; and a glue panel hingedly connected to the joint panel by a third fold line;

wherein the joint panel is angled with respect to the distal end portion and wherein a length of the joint panel is greater than a length of the distal end portion.

2. An article carrier according to claim 1, wherein the lateral partition panel has a length defined by a first distance extending between the first fold line and a distal end of the lateral partition panel and wherein the first distance is generally equal to a second distance between the first panel and the second panel.

3. An article carrier according to claim 2, wherein the second and third fold lines are substantially parallel to each other.

4. An article carrier according to claim 1, wherein the second fold line comprises a pair of intersecting tear stoppers and a weakened line disposed between the tear stoppers.

5. An article carrier according to claim 1, wherein the distal end of the lateral partition panel abuts against the second panel, so as to stabilise the position of the distal end, in cooperation with the angled joint panel.

6. An article carrier according to claim 5, wherein the lateral partition panel forms a brace between the first and second panels.

7. An article carrier according to claim 1, wherein the carrier comprises at least two relief cuts, the relief cuts defining an area of the first panel therebetween, said area being a glue free area, unsecured to another panel of the carrier.

8. An article carrier according to claim 7, wherein the relief cuts and the glue free area create a displaceable region so as to create adjustability of the length of the lateral partition panel.

9. The article carrier of claim 7 wherein the partition structure is automatically erected when the tubular structure is erected from a collapsed condition.

10. The article carrier of claim 1 wherein the tubular structure is collapsible.

11. The article carrier of claim 1 wherein the tubular structure comprises an end closed at least in part by one or more bottom panels.

12. An article carrier comprising a plurality of primary panels defining an interior of the article carrier, the plurality of primary panels including: first and second opposed side panels for forming a tubular structure, a medial partition wall interposed parallel between the first and second side panels to divide the interior into two or more article-receiving cells, and a pair of end closure flaps which at least partially close one of opposed ends of the tubular structure, the end closure flaps comprising at least one press-activated locking feature for interconnecting the end closure flaps, wherein the medial partition wall comprises a backing edge extending alongside an inside surface of at least one of the end closure flaps, and wherein the backing edge of the medial partition wall has at least one recess defined therealong and arranged in registration with the at least one press-activated locking feature.

13. A blank for forming an article carrier, the blank comprising a plurality of primary panels for forming walls of a tubular structure defining an interior chamber, the plurality of primary panels including:

a first panel; and a second panel opposing the first panel;

wherein the blank further comprises a partition structure for dividing the interior into two or more article-receiving cells, the partition structure being formed from the first panel and comprising:

a lateral partition panel hingedly connected at a proximal end thereof to the first panel by a first fold line;

a joint panel hingedly connected to a distal end portion of the lateral partition panel by a second fold line; and a glue panel hingedly connected to the joint panel by a third fold line;

wherein the joint panel is configured to be angled with respect to the distal end portion in a setup carrier and wherein a length of the joint panel is greater than a length of the distal end portion.

* * * * *